US005670958A

United States Patent [19]

Hauser et al.

[11] Patent Number: 5,670,958

[45] Date of Patent: Sep. 23, 1997

[54] REMOTE CONTROL METHOD AND DEVICE

[75] Inventors: Eberhard Hauser; Norbert Eigeldinger, both of Villingen-Schwenningen, Germany

[73] Assignee: Deutsche Thomson Brandt GmbH, Villingen-Schwenningen, Germany

[21] Appl. No.: 495,640

[22] Filed: Nov. 28, 1995

[30] Foreign Application Priority Data

Mar. 17, 1993 [DE] Germany ..... 43 08 441.9

[51] Int. Cl.[6] ..... G08C 19/12

[52] U.S. Cl. ..... 341/176; 341/177; 341/178; 340/825.57

[58] Field of Search ..... 341/176, 177, 341/178, 179, 181, 182; 359/146, 148; 340/825.57, 825.69, 825.72

[56] References Cited

U.S. PATENT DOCUMENTS 4,623,887 11/1986 Welles, II ..... 359/146

4,905,279 2/1990 Nishio ..... 359/176

5,142,398 8/1992 Heep ..... 341/176

FOREIGN PATENT DOCUMENTS 0380371 8/1990 European Pat. Off. .

*Primary Examiner*—Jeffery Hofsass

*Assistant Examiner*—Andrew Hill

*Attorney, Agent, or Firm*—Joseph S. Tripoli; Peter M. Emanuel; Frederick A. Wein

[57] ABSTRACT

The present infra-red remote control transmitter understands external formats, and those with toggle-bits and different carrier frequency ranges, and transmits signals in these data formats to the appropriate devices, with or without a toggle-bit. The remote control receives and transmits infra-red formats and comprises an infra-red receiver with a microprocessor and/or with two carrier frequency oscillators to generate two modulation frequencies, in which case it is provided with two infra-red receivers. An externally formatted data word with toggle-bits is subjected, after being read at least twice, to a comparison inside the microprocessor, from which the presence of toggle-bits, their number, position and the carrier frequency of the data word are found.

8 Claims, 4 Drawing Sheets

REMOTE CONTROL METHOD AND DEVICE

BACKGROUND

The present invention relates to a method and a device for remote control for electronic devices, in particular of entertainment electronics.

A remote control transmitter is generally known. It sends a signal, connected by wire or in a wireless manner, for example infrared light, microwaves, ultrasonic waves or the like, of specific frequencies and codes by means of a transmitting device via a transmission path to a receiving device which recognizes the signal codes transmitted and thereupon executes specific commands contained in the signal codes.

Furthermore, it is known, for example from EP 289625 B1, that there are remote control transmitters which can recognize foreign transmission formats, such as infrared formats from other manufacturers or for other devices, store these and transmit these again as required. Such infrared remote control transmitters are also called "learning" remote control transmitters. Learning remote control transmitters are always useful when two or more remotely operable devices which are independent of each other, in particular those from different manufacturers, are intended to be operated with a single infrared remote control transmitter. In order to prepare them for the storage of a foreign infrared format, one of a plurality of possible keys is pressed on the "learning" remote control transmitter. After the successful transmission of a foreign format from an original remote control transmitter, further commands of the foreign format can be assigned to keys of the "learning" remote control transmitter. The foreign format of the original remote control transmitter is thus recognized and stored.

In the case of the known learning remote control transmitters the fact that data formats which contain so-called toggle bits in their data word are not correctly recognized by them is disadvantageous, as is the fact that different carrier frequency ranges are not detected. In addition, such "learning" remote control transmitters usually operate in the range from about 30 kHz to about 40 kHz, so that data formats having a carrier frequency in the range from, for example, 390 kHz to about 500 kHz cannot be determined and cannot be correctly simulated in transmitting operation.

Toggle bits are as a rule transmitted at the beginning of a data word and assume either the logic state "1" or "0". Their state is maintained until the corresponding data word is no longer being transmitted. Toggle bits have the task of being able to differentiate multiple, identical and persistent key presses from one another in a troublefree manner. Conventional "learning" remote control transmitters would no longer recognize as the same command the same data word which is transmitted once more by means of a renewed key press after a short interruption, but this time with the toggle bit state "0" (if it was previously "1").

This is always the case when, for example, a program place 11, 22, 33 etc. is intended to be selected by means of double actuation in each case of digit keys 1, 2, 3 etc. The same is also true for a "MUTE" key which, as a result of double pressing, switches the sound off and then on once more. Without a state change of the toggle bit, the receiver software cannot recognize the retransmitted command as new. In this case, further transmission of the same command having the same toggle bit state has no effect or an undesired effect (e.g. the state "MUTE" cannot be cancelled or, instead of the desired program place "11", a changeover is made to the program place "1"). Versatile use of the known learning remote controls is thus impossible.

The operation of an infrared remote control transmitter which operates according to the known learning method can consequently lead to failure, in particular when the original remote control transmitter, whose infrared format is intended to be recognized and stored by the learning remote control transmitter, contains a toggle bit in the data word. Erroneous recognitions and/or erroneous operations are thus to be expected. Frequent complaints in this respect are known from publications.

The present invention is based on the object of also being able to recognize and reproduce those transmission formats which contain at least one toggle bit in their data word. In this case it is advantageously immaterial whether one or more toggle bits are contained in the data word and in which position toggle bits are located in the data word.

The invention achieves the object in that at later times at least one further remote control signal for the same remote control command is transmitted by the first remote control transmitter and is received and stored by the second remote control transmitter, the value of the further remote control signal is compared with the value of the first remote control signal and, on the basis of the comparison, the remote control signal assigned to the remote control command is formed.

In principle, a device according to the invention for learning and transmitting remote control signals can be implemented in that, with the aid of a first memory, initially at least two different remote control signals containing the same command are stored, with the aid of a comparator the values of the previously stored remote control signals are examined for time differences, with the aid of a second memory (RAM) the results resulting from the comparison are stored there and, with the aid of an encoder at a later time the values of the original remote control signals are formed.

In this case it can additionally be provided that, with the aid of the same device, further remote control signals containing different commands and processed in accordance with the same method can be stored, compared and transmitted.

BRIEF DESCRIPTION OF THE DRAWINGS

The invention is explained in more detail below with reference to exemplary embodiments, using the drawing.

DETAILED DESCRIPTION OF THE PREFERRED EMBODIMENT

Figure 1:
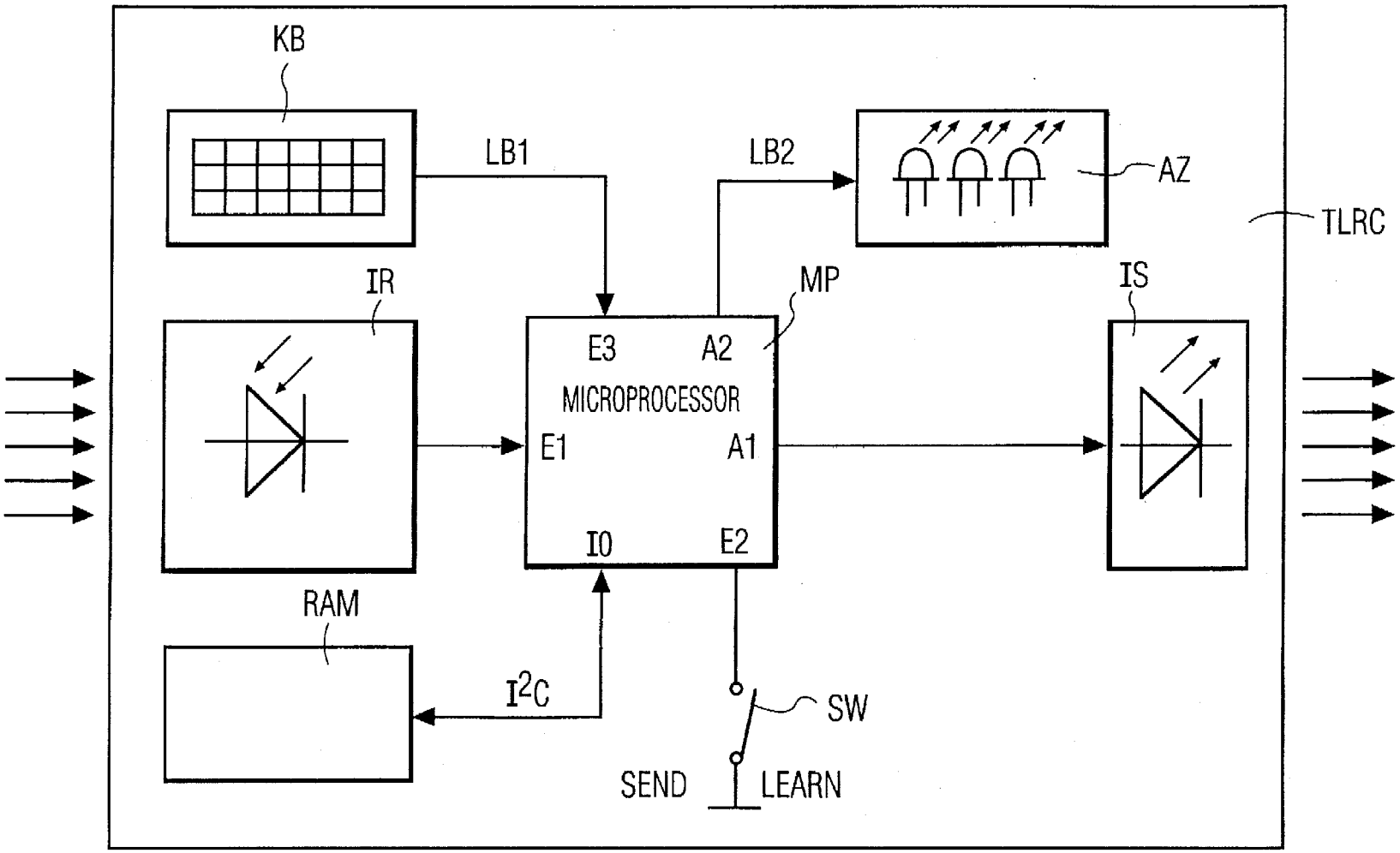
FIG. 1 shows a block diagram of an arrangement of a toggle bit-learning remote control having a "fast" microprocessor.

Before the description of the exemplary embodiments is gone into, it should be pointed out that the blocks shown individually in the figures serve only for the better understanding of the invention. Normally, individual blocks or a plurality of these blocks are combined into units. These can be implemented using integrated or hybrid technology or as a program-controlled microcomputer, or as part of a program suitable for its control. The elements contained in the individual stages can also be implemented separately, however.

Firstly, the construction of the exemplary embodiment of FIG. 1 will be described. Here, the original infrared format is forwarded for processing from an infrared receiver IR to a first input E1 of a control device, which can be a microprocessor MP. A switch SW, which has one pole connected to reference potential and its other connected to a second input E2 of the microprocessor MP, switches on the mode of operation "LEARN" or "SEND". A key matrix KB is connected via a first line bus LB1 to a third input E3 of the microprocessor MP. An external memory RAM is connected using a bidirectional line bus $I^2C$ to an input or output IO of the microprocessor MP. A first output A1 of the microprocessor MP supplies its data words to an infrared transmitter IS which amplifies the data words and transmits them as infrared light. An indicator device AZ of optical and/or acoustic type is driven by a second output A2 of the microprocessor MP via a second line bus LB2.

In the following, the data word is examined for toggle bits. Infrared data words are read in twice in succession by the toggle bit-learning remote control transmitter, hereinafter designated TLRC (TLRC=Toggle Bit Learning Remote Control), which is shown in FIG. 1. For this purpose, the user first actuates on the TLRC the switch SW which sets the TLRC to be ready to learn. Thereupon, the microprocessor MP drives the indicator device AZ which can advantageously contain light-emitting diodes or an LCD display. The indicator device AZ shows the user whether the TLRC is ready to receive the first data word of the original remote control. The user now selects a key on the keyboard KB of the TLRC, so that this can accept the command of the original remote control. Subsequently, using the original remote control, the command is transmitted to the TLRC until it has been read by the microprocessor MP and stored in a memory table of the microprocessor MP. The microprocessor MP then drives the indicator device AZ in a corresponding manner to inform the user about the successful storage.

By means of the indicator device AZ, the microprocessor MP requests the user to repeat the same procedure. After the second reading of the data word, the two data words read in and stored in two tables within the microprocessor MP are examined for toggle bits by means of a comparison.

In order to establish toggle bits in the data word, the tables from the first and the second reading procedure are examined. The measured times, which correspond to the logic states of the data bits, are stored in the tables.

Figure 4:
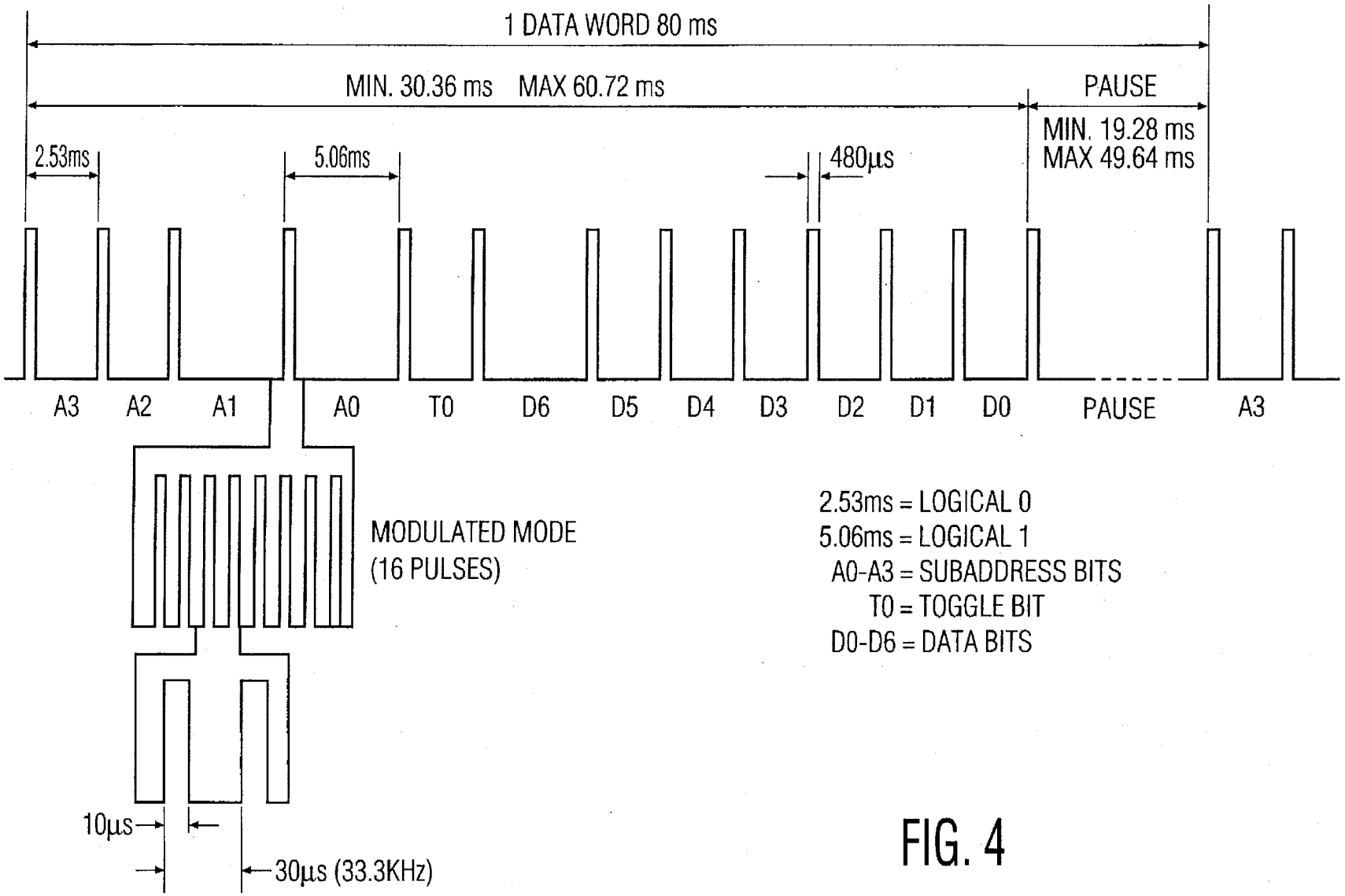
FIG. 4 shows a timing diagram of an infrared data word.

FIG. 4 shows a typical example of a timing diagram of an infrared remote control transmitter. As can be seen from this, the timing diagram has at the points A0, A1 and D6 time-dependent bit states of a logic "1" of, for example, a length of 5.06 milliseconds. Logic bit states of a "0" are transmitted with a time duration of, for example, 2.53 milliseconds.

A comparison takes place between the time-dependent bit states at the same table position. If, in the present example, the times differ by less than 150 microseconds, the two times are regarded as identical and an internal table pointer is increased by one place. If the time difference is greater than 150 microseconds, different logic states are present at this position in the data words read in. This is judged to be a toggle bit position. The position is stored in an information byte and in the same byte one bit is set which shows that this is a data format having at least one toggle bit. This is of importance for the examination of the table for further toggle bits and for the transmission operation.

After the comparison of a table position, the internal table pointer of the microprocessor MP is incremented and the next table position is examined. If the differences of each individual table position of the two data words have been determined, the information obtained therefrom is stored in an information byte and the times which differ are stored in the internal RAM of the microprocessor MP.

In the present example, the tolerance time is, at 150 microseconds, greater by a factor 3 than the maximum measured inaccuracy in the case of repeated transmission of the same times from one and the same original remote control transmitter.

In order to test the number of permitted toggle bits (a maximum of two in usual infrared data formats), the position of the toggle bit in the data word (=table location) must also be stored.

By incrementing the table pointer, it is tested during the further comparison whether a second toggle bit is present. In this exemplary embodiment, a maximum of only two toggle bits is permitted and these must follow each other directly. If a permitted position is concerned, the current bit position must be greater by 1 (one) than the position stored in the information byte. If this is not the case, there is an error which, for example, stems from a disturbance during reading in. Changing one single toggle bit is sufficient for the receiver software of the remotely controllable device to recognise an identical, repeated key press. For this reason, only the position of the toggle bit established first is stored.

The times which differ are stored in the internal RAM of the microprocessor MP in reserved memory locations. This is necessary because the data word has to be regenerated once again before being transmitted.

A further refinement of the exemplary embodiment consists in the possibility of being able to differentiate and process more than just one carrier frequency range. Two usual carrier frequency ranges in the field of entertainment electronics are known, specifically from about 30 kHz to about 40 kHz and from about 390 kHz to about 500 kHz. As a result, a versatile capability of use of the learning remote control transmitter TLRC according to the invention is achieved.

To determine and generate the carrier frequencies, the exemplary embodiment shown in FIG. 1 could contain as control device a fast microprocessor MP which can reliably measure and reproduce the incoming frequencies at up to 500 kHz, which corresponds to a period duration of 2 microseconds.

The arrangement in FIG. 1 provides only one single broadband infrared receiver IR having an infrared receiving diode which routes the carrier frequencies between 30 kHz and 500 kHz to its output. The fast microprocessor MP, connected downstream of the infrared receiver IR, can measure the frequencies directly and store their values or convert these into 2 decision criteria. One decision refers to the lower, the other to the upper carrier frequency range. This means that, for example, upon recognizing an "upper" frequency range, a bit is set to "1" in the information byte and, upon recognizing a "lower" frequency range, this frequency-designating bit is set to "0". After the examination of the data words for toggle bits, that is to say the determination of their number and position and frequency range, the microprocessor MP stores all the information relevant to the regeneration of the data word, such as, for example, measured time sequence, toggle bit times and information byte, in the external memory RAM via the $I^2C$ bus.

When retrieving the data word to be regenerated, the user puts the switch SW into the position "SEND" and actuates a key, corresponding to the command to be executed, on the keyboard KB of the toggle bit-learning remote control transmitter TLRC. The microprocessor MP then reads, via the $I^2C$ bus, the information from the external memory RAM, regenerates the original data word in all its essential details, such as also the modulation of the carrier frequency, and transmits it essentially in its original condition via the infrared transmitting stage IS to the receiving device.

Figure 2:
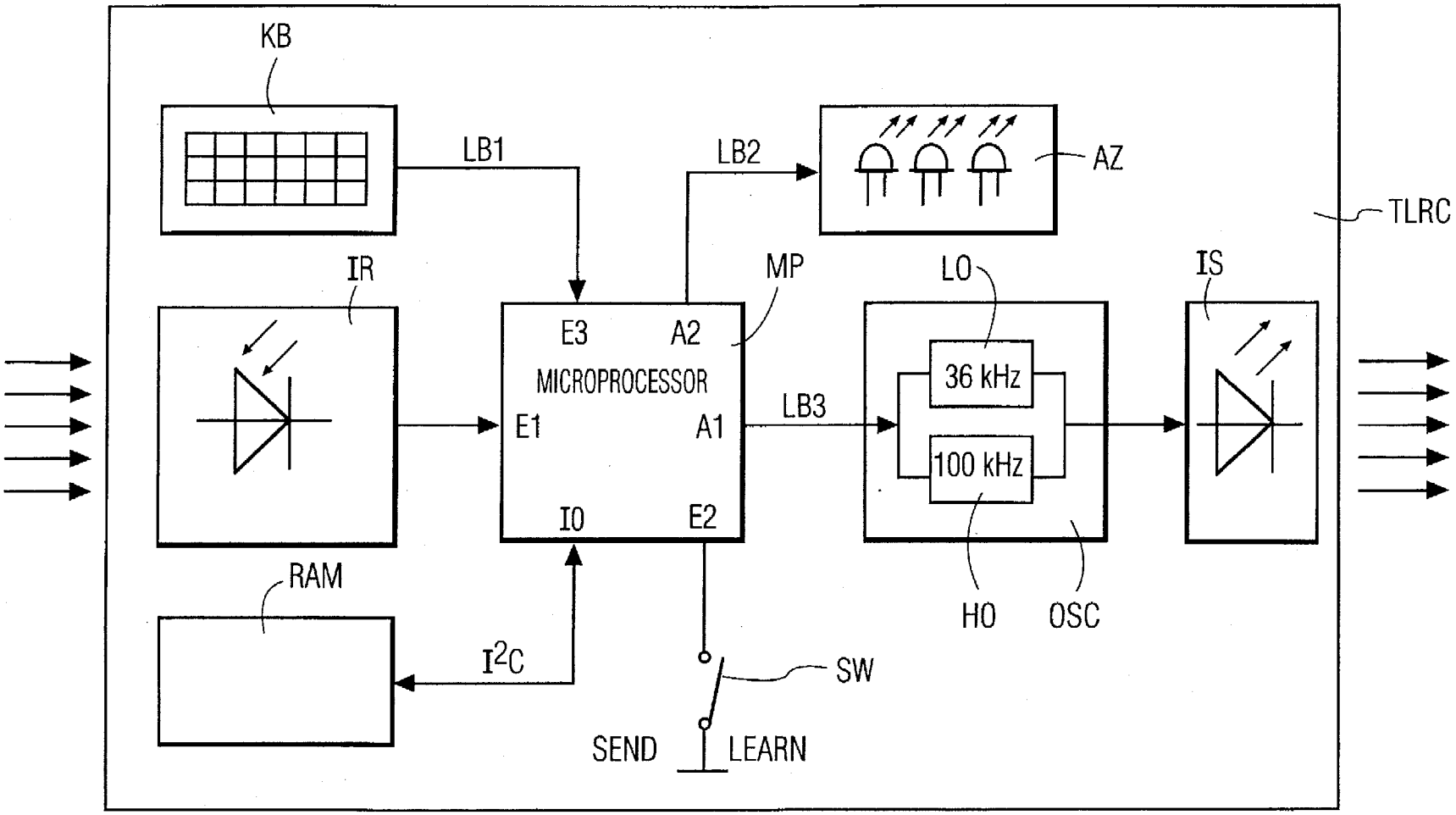
FIG. 2 shows a block diagram of an arrangement of a toggle bit-learning remote control having two carrier frequency oscillators.

A second exemplary embodiment in FIG. 2 contains two carrier frequency oscillators. It differs from the first exemplary embodiment shown in FIG. 1 inasmuch as, between the output A1 of the microprocessor MP and the input of the infrared transmitter IS, there is now an oscillator stage OSC having two parallel-connected oscillators LO and HO, which can be driven alternately by the output A1 of the microprocessor MP via a third line bus LB3.

Just as was described in connection with the first exemplary embodiment, this arrangement contains only one single broadband infrared receiver IR having an infrared receiving diode, and a microprocessor which here contains no internal carrier frequency oscillator, however. Instead, it can be more cost-effective to design the microprocessor MP as a slow microprocessor and to connect downstream of this a double oscillator stage OSC which comprises, on the one hand, an oscillator having a low frequency LO (about 36 kHz) and, on the other hand, an oscillator having a high frequency HO (400 kHz). Depending on the carrier frequency which was originally modulated to form the original data format, the microprocessor MP activates either the one or the other oscillator. Everything else remains as already described above in relation to the first exemplary embodiment, for which reason the reference symbols used there have also been retained.

Figure 3:
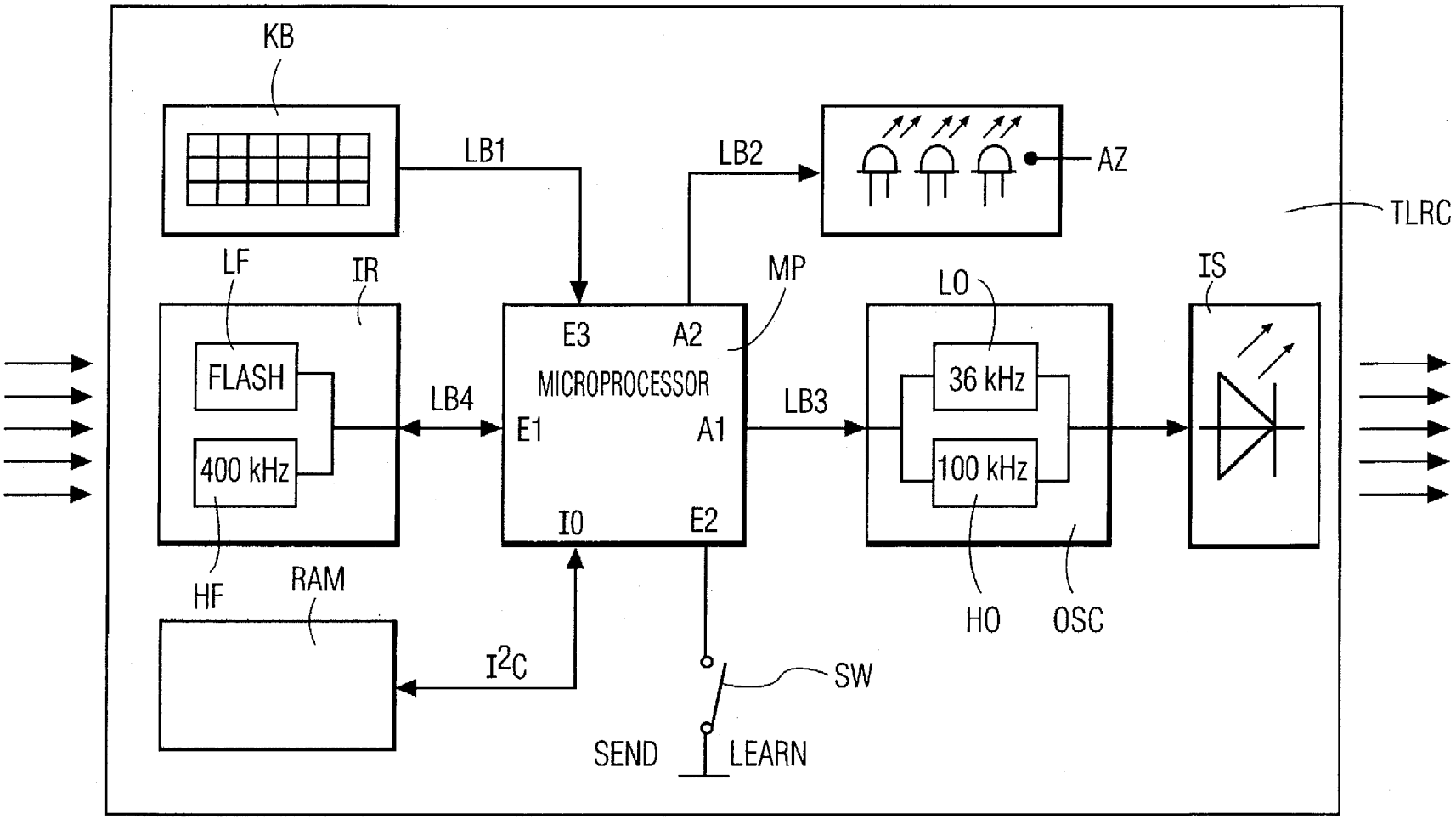
FIG. 3 shows a block diagram of an arrangement of a toggle bit-learning remote control having two infrared receivers and two carrier frequency oscillators.

A solution which is advantageous because it is very cost-effective is shown in the third exemplary embodiment in FIG. 3. This represents an expansion of the second exemplary embodiment described in connection with FIG. 2, a generally normal microprocessor (for example Motorola type MC68HC805C4) being able to be used. The infrared receiver stage IR contains two parallel-connected infrared receivers LF and HF, which can be driven through the connection E1 of the microprocessor MP, via a fourth line bus LB4.

The reading of the infrared commands is initially carried out with the aid of a first infrared receiver LF having a lower pass range for frequencies from 30 kHz to 40 kHz (e.g. type IS1U60 from Sharp). Together with the second infrared receiver HF, which reacts to frequencies in the range from 390 kHz to 500 kHz (e.g. type TFMT 4040 from Telefunken), the carrier frequency range can be determined.

For this purpose, during the procedure of reading in the data words, a changeover is made from the first infrared receiver LO to the second infrared receiver HF. During a time window (e.g. 261 ms), the negative edges of the data words which are received by the second IR receiver HF and are sampled at a carrier frequency in the range from 390 kHz to 455 kHz trigger interrupts. The interrupts are counted in an interrupt routine within the microprocessor MP. If the carrier frequency lies in the lower range, that is to say between 30 kHz and 40 kHz, no signal is allowed through, as a result of the pass range of the IR receiver HF. However, if the user fixes too small a separation between the toggle bit-learning remote control TLRC and the original remote control, or unfavourable light conditions are present, there is the possibility that in spite of the lower carrier frequency range, a few interrupts are counted. However, this is of no further importance since, for example, at a number of more than 6interrupts, the "upper" carrier frequency range can be recognized. Known data formats in the upper carrier frequency range (e.g. formats from NEC, Philips, Ferguson, SABA, Telefunken and Nordmende) trigger interrupts according to their bit count.

The entire information of the data words as well as the information about toggle bit, the different times of the toggle bit states, number, position, carrier frequency range and further program-place-relevant data (channel assignment, timer data, VPS, etc.) are read into the external memory RAM with the aid of the $I^2C$ bus and are stored there until retrieved. If the data are to be transmitted, the switch SW must be set from "LEARN" to "SEND" in order that the microprocessor MP can read the data from the external memory RAM. In the microprocessor, the data from the external memory RAM are conditioned to form the complete data word using the information from the information byte. In the event that one or more toggle bits are present in the data word, at each renewed key press of a key assigned to this data word, on the keyboard KB, the state of the toggle bit(s) is also changed or incremented by 1. After analysing the data, the microprocessor activates either the 36 kHz carrier frequency oscillator LO or the 400 kHz carrier frequency oscillator HO, in order that the data word corresponding to the original can be sent via the infrared transmitting stage IS to the receiving device.

We claim:

1. Method for learning remote control signals of a first remote control transmitter, which initially transmits first remote control signals for a prescribed remote control command, which are received by a second remote control transmitter which is designed to receive and transmit remote control signals, comprising:

the value of the first signals of the first remote control transmitter being stored in the second remote control transmitter, second or further remote control signals which differ from the first remote control signals by at least one toggle-bit are recognized, the value of the first, second or further remote control signals are entered in respective tables of one of a microprocessor and a memory of the second remote control transmitter, time values of the signals are analyzed with respect to time differences, wherein the signals are compared whether the difference of the measured time values between two corresponding rising edges of the first, second or further remote control signals exceeds a predetermined value and that, if true, it is recognized, that at the corresponding position in the received remote control command, different logical states occur and that this position is judged to be a toggle-bit position.

2. Method according to claim 1, wherein the remote control signals can be uncoded and/or encoded commands and exhibit:

a series of time-controlled pulses, a bit sequence, an alternating or inverting bit sequence, and/or a light frequency, clock frequency or carrier frequency.

3. Method according to claim 1, wherein the comparison of the tables is continued and, providing a time difference is again determined at a further position, a test is made as to whether this is a further toggle-bit which in this case must lie further by one position in the table than the first-determined toggle-bit position, otherwise this is an error.

4. Method according to claim 1, wherein part of an information byte stored in the microprocessor or in the memory is used for identifying the carrier frequency range which was modulated to form the original remote control signals, in particular, a bit of the information byte is set to "1" or "0".

5. Method according to claim 4, wherein a frequency-identifying bit(s) which is/are stored in the information byte are used for activating an oscillator which, to form the remote control signals to be regenerated, modulates a carrier frequency which essentially corresponds to that which was modulated to form the original remote control signals.

6. Method according to claim 4, wherein one of a plurality of possible carrier frequencies is modulated as a function of the information bit(s) stored in the memory to form the remote control signals to be transmitted.

7. Method according to claim 4, wherein in the second remote control transmitter, a first carrier frequency in the region of 36 kHz and/or in that a second carrier frequency in the region of 400 kHz is modulated to form the remote control signals to be transmitted.

8. Method for learning remote control signals of a first remote control transmitter, which initially transmits first remote control signals for a prescribed remote control command, which are received by a second remote control transmitter which is designed to receive and transmit remote control signals, the value of the first signals of the first remote control transmitter being stored in the second remote control transmitter, comprising:

at later times second or further remote control signals for the same remote control command are transmitted by the first remote control transmitter and are received and stored by the second remote control transmitter, the value of the second or further remote control signals is compared in the second remote control transmitter with the value of the first remote control signals and on the basis of the comparison in the second remote control transmitter, the remote control signals assigned to the remote control commands are formed, in the second remote control transmitter, during reading of the data words for determining the frequency range, a changeover is made from a first infrared receiver to a second infrared receiver, the frequencies of the received frequency range trigger interrupts in an interrupt routine of a microprocessor to determine the carrier frequency, the microprocessor evaluates these interrupts, and the microprocessor stores the information obtained therefrom as a bit in an information byte and the entire information of the information byte in the microprocessor or in an external memory for later regeneration of the data word.

* * * * *